US008099023B2

(12) United States Patent
Law

(10) Patent No.: US 8,099,023 B2
(45) Date of Patent: Jan. 17, 2012

(54) CONFORMABLE, ELECTRICALLY RELAXABLE RUBBERS USING CARBON NANOTUBES FOR BCR/BTR APPLICATIONS

(75) Inventor: Kock-yee Law, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 656 days.

(21) Appl. No.: 11/688,604

(22) Filed: Mar. 20, 2007

(65) Prior Publication Data

US 2008/0232853 A1 Sep. 25, 2008

(51) Int. Cl.
*G03G 15/02* (2006.01)
*G03G 15/16* (2006.01)

(52) U.S. Cl. ..... 399/176; 399/313

(58) Field of Classification Search ..... 399/176, 399/313; 428/299.1

See application file for complete search history.

(56) References Cited

U.S. PATENT DOCUMENTS 6,141,516 A * 10/2000 Law et al. ..... 399/176
6,160,980 A * 12/2000 Ziegelmuller et al. ..... 399/303
6,427,062 B1 * 7/2002 Takeuchi ..... 399/388
6,454,688 B1 * 9/2002 Okuda et al. ..... 492/56
2003/0053821 A1 * 3/2003 Miyakawa et al. ..... 399/159
2004/0086305 A1 * 5/2004 Stulc et al. ..... 399/308

FOREIGN PATENT DOCUMENTS

JP 2004101958 A * 4/2004
JP 2007023149 A * 2/2007

OTHER PUBLICATIONS

English machine translation of JP2004-101958.*
Machine English Translation of JP2007-023149.*

* cited by examiner

*Primary Examiner* — David Gray
*Assistant Examiner* — Billy J Lactaoen
(74) *Attorney, Agent, or Firm* — MH2 Technology Law Group LLP

(57) ABSTRACT

Exemplary embodiments provide bias-able devices for use in electrostato-graphic printing apparatuses using conformable and electrically relaxable rubber materials. The rubber material can include a plurality of nanotubes distributed uniformly and/or spatially-controlled throughout a rubber matrix for providing the rubber material with a uniform mechanical conformability and a uniform electrical resistivity. The rubber material can be used as a functional layer disposed over a conductive substrate such as a conductive core depending on the specific design or engine architecture. Other functional layers can also be disposed over the conductive substrate and/or the rubber material of the bias-able devices including bias charging rolls (BCRs) and bias transfer rolls (BTRs).

19 Claims, 4 Drawing Sheets

CONFORMABLE, ELECTRICALLY RELAXABLE RUBBERS USING CARBON NANOTUBES FOR BCR/BTR APPLICATIONS

DESCRIPTION OF THE INVENTION

1. Field of the Invention

This invention relates generally to bias-able devices used in an electrostato-graphic printing machine and methods for forming the bias-able devices, and, more particularly, to functional layer(s) used in the bias-able devices.

2. Background of the Invention

Bias-able devices such as bias charging rolls (BCRs) and bias transfer rolls (BTRs) are critical components in charging or transfer subsystem for printing apparatus engines, particularly for the 4-cycle and Tandem architecture in color products. The most critical functional requirements for the BCRs and the BTRs are being electrically relaxable, mechanically compliant, and strong enough to carry out the charging or transfer function. Generally, rubbers of low durometer can provide highly desirable mechanical functions for such as nip forming at the required interfaces, for example, between the loaded BCRs and the photoreceptor drums of printing machines.

Conventional methods for making rubber electrically conductive include adding conductive filler materials into the rubber. For example, ionic fillers can be added to a rubber providing a higher dielectric strength (e.g., high breakdown voltage). Problems arise, however, because the conductivity of rubber is very sensitive to humidity and/or temperature. A conventional solution for reducing this sensitivity to the environmental changes is using particle filler systems in the rubber. This, however, reduces the breakdown voltage of the resulting rubber. In addition, the mechanical properties of the rubber can be affected by the introduction of the filler materials into the rubber. For example, the rubber may become harder and have a lower modulus due to the addition of the particle filler materials.

Thus, there is a need to overcome these and other problems of the prior art and to provide a material with environment robustness that is electrically conductive in the desirable range as well as mechanically compliant and strong.

SUMMARY OF THE INVENTION

According to various embodiments, the present teachings include a bias-able device. The bias-able device can include a rubber material disposed over a conductive substrate. The rubber material can include a plurality of nanotubes distributed throughout a rubber matrix. The rubber material can have a mechanical conformability and an electrical resistivity of about $10^5$ ohm-cm to about $10^{10}$ ohm-cm.

According to various embodiments, the present teachings also include a method for forming a bias-able device. In this method, a rubber material can be formed upon an electrically conductive core. The rubber material can include a plurality of nanotubes dispersed throughout a rubber matrix. The rubber material can have an electrical resistivity and a mechanical conformability.

According to various embodiments, the present teachings further include a bias-able device. The bias-able device can include a rubber material disposed over and surrounding an electrically conductive core. The rubber material can include a plurality of nanotubes dispersed throughout a rubber matrix. The rubber material can have a first electrical resistivity and a mechanical conformability. The bias-able device can also include a surface material disposed over and surrounding the rubber material, wherein the surface material can include a second electrical resistivity and a protecting surface.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

DESCRIPTION OF THE EMBODIMENTS

Figure 1A:
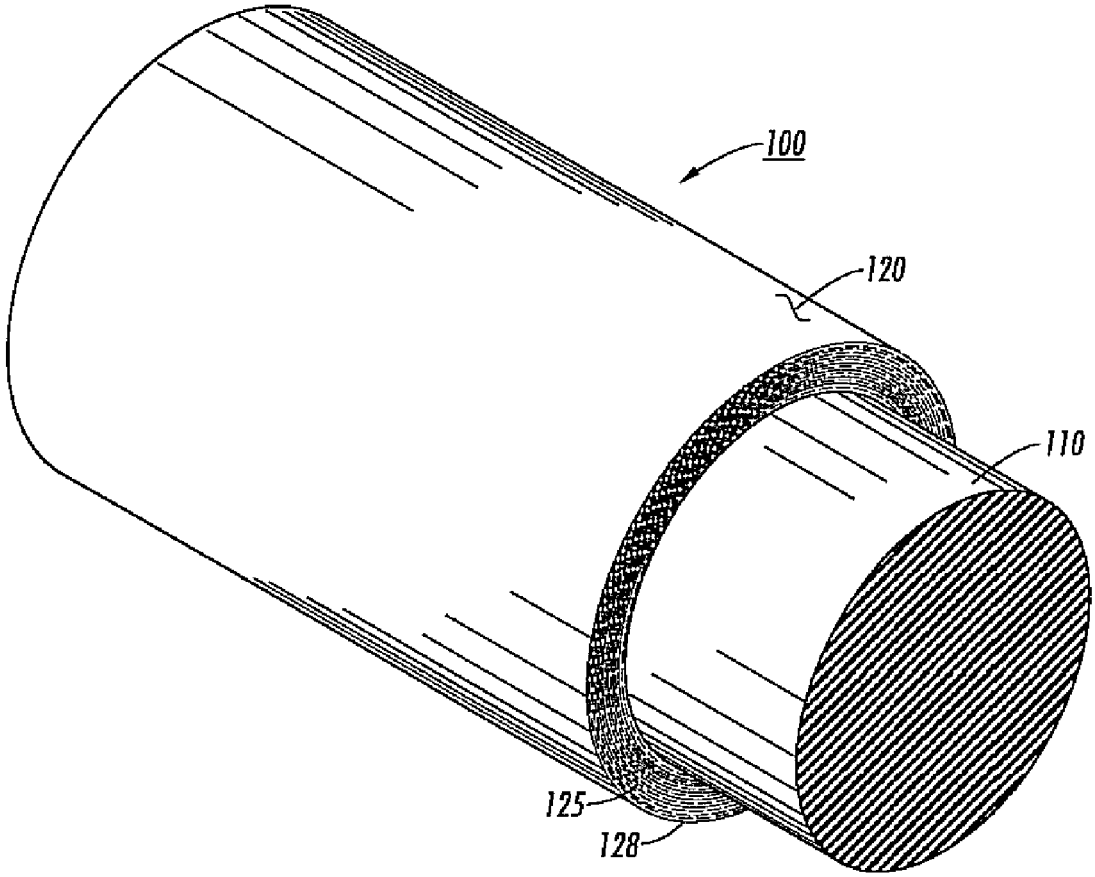
FIGS. 1A-1B depict an exemplary single-layer bias-able device including a rubber material disposed upon a conductive substrate in accordance with the present teachings.

Reference will now be made in detail to the present embodiments (exemplary embodiments) of the invention, examples of which are illustrated in the accompanying drawings. Wherever possible, the same reference numbers will be used throughout the drawings to refer to the same or like parts. In the following description, reference is made to the accompanying drawings that form a part thereof, and in which is shown by way of illustration specific exemplary embodiments in which the invention may be practiced. These embodiments are described in sufficient detail to enable those skilled in the art to practice the invention and it is to be understood that other embodiments may be utilized and that changes may be made without departing from the scope of the invention. The following description is, therefore, merely exemplary.

While the invention has been illustrated with respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." As used herein, the term "one or more of" with respect to a listing of items such as, for example, A and B, means A alone, B alone, or A and B. The term "at least one of" is used to mean one or more of the listed items can be selected.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5.

Exemplary embodiments provide bias-able devices for use in electrostato-graphic printing apparatuses using rubber materials, which are mechanically conformable and electrically relaxable. In various embodiments, the bias-able devices can take various forms, such as, for example, rolls, films, belts and the like. Exemplary bias-able devices can include, but are not limited to, bias charging rolls (BCRs) or bias transfer rolls (BTRs), which can be subsystems of an electrostato-graphic printing apparatus. In various embodiments, the bias-able device can include a rubber material disposed over a conductive substrate such as a conductive core depending on the specific design and/or engine architecture. The disclosed rubber material can include a plurality of nanotubes as filler materials dispersed in a rubber (or polymer) matrix.

As used herein and unless otherwise specified, the term "nanotubes" refers to elongated materials (including organic or inorganic material) having at least one minor dimension, for example, width or diameter, about 100 nanometers or less. Although the term "nanotubes" is referred to throughout the description herein for illustrative purposes, it is intended that the term also encompass other elongated structures of like dimensions including, but not limited to, nanoshafts, nanopillars, nanowires, nanorods, and nanoneedles and their various functionalized and derivatized fibril forms, which include nanofibers with exemplary forms of thread, yarn, fabrics, etc. The term "nanotubes" can also include single wall nanotubes such as single wall carbon nanotubes (SWCNTs), multi-wall nanotubes such as multi-wall carbon nanotubes, and their various functionalized and derivatized fibril forms such as nanofibers. In various embodiments, the term "nanotubes" can further include carbon nanotubes, which can include SWCNTs and/or multi-wall carbon nanotubes.

The nanotubes can have various cross sectional shapes, such as, for example, rectangular, square, polygonal, oval, or circular shape. Accordingly, the nanotubes can have, for example, a cylindrical 3-dimensional shape.

The nanotubes can be formed of conductive or semi-conductive materials. In some embodiments, the nanotubes can be obtained in low and/or high purity dried paper forms or can be purchased in various solutions. In other embodiments, the nanotubes can be available in the as-processed unpurified condition, where a purification process can be subsequently carried out.

The nanotubes can be distributed uniformly throughout and/or spatially-controlled throughout a rubber matrix forming a rubber material. In some embodiments, the nanotubes, such as carbon nanotubes, can be bundled tubes with random tangles throughout the rubber material by a physical or chemical bonding with desirable rubbers. In other embodiments, the nanotubes, such as carbon nanotubes, can be spatially-controlled, for example, be aligned or oriented at certain directions throughout the rubber matrix by, for example, use of a magnetic field.

In various embodiments, the rubber material can be prepared by a physical mix and/or a chemical reaction including a biochemical reaction or their combination between the nanotubes and one or more rubbers. For example, carbon nanotubes can be physically mixed and dispersed uniformly within the rubber matrix. Alternatively, the carbon nanotubes can be covalently bonded with various rubbers forming the rubber material by, for example, chemical modifications on nanotubes surfaces followed by chemical reactions between the modified nanotubes and the rubber. In various embodiments, enzymes can be used in biochemical reactions to provide an environmentally-friendly rubber material for the bias-able devices. In various embodiments, a sonication process or other enhanced mixing process can be used during the preparation.

The rubber material can also be prepared by, for example, in-situ processes such as an in-situ polymerization and/or an in-situ curing process of the rubbers of interest. For example, carbon nanotubes can be dispersed uniformly throughout an exemplary rubber of polyimide matrix during an in-situ polymerization of the polyimide monomers. In another example, carbon nanotubes can be dispersed throughout an epoxy type rubber matrix during the curing process of the epoxy.

In various embodiments, the disclosed rubber material can be used in the bias-able devices for providing exceptional and desired functions, such as, mechanical and electrical functions for the devices. Specifically, the rubber material can provide conformability, that is, being mechanically compliant and also strong enough for forming a nip for the bias-able devices such as BCRs. In addition, the rubber materials can provide electrical resistivity for bias charge of, for example, the photoreceptors connected to BCRs. In various embodiments, the rubber material can provide a resistivity ranging, for example, from about $10^5$ ohm-cm to about $10^{10}$ ohm-cm, to allow charges to relax across the functional layers while being resistive enough to avoid bias leaks at high field.

In an exemplary embodiment, the rubber material can include carbon nanotubes, for example, SWCNTs with a weight loading of, for example, about 2.0% or less to retain the mechanical property of, for example, tensile strength and conformability of the rubber matrix.

In various embodiments, other filler materials besides nanotubes can be added into the rubber material. The other fillers can include one or more materials selected from the group consisting of carbon, graphite, $SnO_2$, $TiO_2$, $In_2O_3$, ZnO, MgO, $Al_2O_3$, and metal powders such as Al, Ni, Fe, Zn, or Cu.

In various embodiments, the rubber material can include a variety of rubbers used as a functional layer of the bias-able devices. As used herein, the term "rubber" refers to any elastomer (i.e., elastic material), that emulates natural rubber in that they stretch under tension, have a high tensile strength, retract rapidly, and substantially recover their original dimensions (or become even smaller in some embodiments). The term "rubber" includes natural and man-made (synthetic) elastomers, and the elastomers can be a thermoplastic elastomer or a non-thermoplastic elastomer. The term "rubber" can include blends (e.g., physical mixtures) of elastomers, as well as copolymers, terpolymers, and multi-polymers.

Exemplary rubbers can include, but are not limited to, ethylene-propylene-diene monomers (EPDM), epichlorohydrin, polyurethane, silicone, and various nitrile rubbers which can be copolymers of butadiene and acrylonitrile such as Buna-N (also known as standard nitrile and NBR). In an additional example, by varying the acrylonitrile content, elastomers with improved oil/fuel swell or with improved low-temperature performance can be achieved. Other useful rubbers can include, but are not limited to, polyvinylchloride-nitrile butadiene (PVC-NBR) blends, chlorinated polyethylene (CM), chlorinated sulfonate polyethylene (CSM), aliphatic polyesters with chlorinated side chains such as epichlorohydrin homopolymer (CO), epichlorohydrin copolymer (ECO) and epichlorohydrin terpolymer (GECO), polyacrylate rubbers such as ethylene-acrylate copolymer (ACM), ethylene-acrylate terpolymers (AEM), EPR, elastomers of ethylene and propylene which sometimes can have a third monomer such as ethylene-propylene copolymer (EPM), ethylene vinyl acetate copolymers (EVM), butadiene rubber (BR), polychloroprene rubber (CR), polyisoprene rubber (IR), IM, polynorbornenes, polysulfide rubbers (OT and EOT), polyurethanes (AU) and (EU), silicone rubbers (MQ), vinyl silicone rubbers (VMQ), phenylmethyl silicone rubbers (PMQ), styrene-butadiene rubbers (SBR), copolymers of isobutylene and isoprene known as butyl rubbers (IIR), brominated copolymers of isobutylene and isoprene (BIIR) and chlorinated copolymers of isobutylene and isoprene (CIIR).

In various embodiments, the bias-able devices can be used in a "green" environment, that is, all parts, components, and materials of the devices can be manufactured in an "environmentally acceptable" fashion. The "green" rubbers used in the rubber materials for the bias-able devices can include, but are not limited to, biocompatible rubber materials, such as, for example, polycarboxylic acids, cellulosic polymers including cellulose acetate and cellulose nitrate, gelatin, polyvinylpyrrolidone including cross-linked polyvinylpyrrolidone, polyanhydrides including maleic anhydride polymers, polyamides, polyvinyl alcohols, copolymers of vinyl monomers such as EVA, polyvinyl ethers, polyvinyl aromatics, polyethylene oxides, glycosaminoglycans, polysaccharides, polyesters including polyethylene terephthalate, polyacrylamides, polyethers, polyether sulfone, polycarbonate, polyalkylenes including polypropylene, polyethylene and high molecular weight polyethylene, halogenated polyalkylenes including polyurethanes, polyorthoesters, proteins, polypeptides, enzymes, silicones, siloxane polymers, polylactic acid, polyglycolic acid, polycaprolactone, polyhydroxybutyrate valerate, styrene-isobutylene copolymers and blends and copolymers thereof. Other examples of the "green" rubbers can include polyurethane, fibrin, collagen and derivatives thereof, polysaccharides such as celluloses, starches, dextrans, alginates and derivatives, hyaluronic acid, squalene, etc.

Additional suitable "green" rubbers can include, thermoplastic elastomers in general, polyolefins, polyisobutylene, ethylene-alphaolefin copolymers, acrylic polymers and copolymers, vinyl halide polymers and copolymers such as polyvinyl chloride, polyvinyl ethers such as polyvinyl methyl ether, polyvinylidene halides such as polyvinylidene fluoride and polyvinylidene chloride, polyacrylonitrile, polyvinyl ketones, polyvinyl aromatics such as polystyrene, polyvinyl esters such as polyvinyl acetate, copolymers of vinyl monomers, copolymers of vinyl monomers and olefins such as ethylene-methyl methacrylate copolymers, acrylonitrile-styrene copolymers, ABS (acrylonitrile-butadiene-styrene) resins, ethylene-vinyl acetate copolymers, polyamides such as Nylon 66 and polycaprolactone, alkyd resins, polycarbonates, polyoxymethylenes, polyimides, epoxy resins, rayon-triacetate, cellulose, cellulose acetate, cellulose butyrate, cellulose acetate butyrate, cellophane, cellulose nitrate, cellulose propionate, cellulose ethers, carboxymethyl cellulose, collagens, chitins, polylactic acid, polyglycolic acid, polylactic acid-polyethylene oxide copolymers, EPDM (ethylene-propylene-diene) rubbers, polyethylene glycol, polysaccharides, phospholipids, and combinations of the foregoing.

In various embodiments, rubbers can be obtained from chemical modifications (e.g., derivatives), and be used in rubber materials to provide additional functions and/or to improve the performance of the bias-able devices. For example, a polyurethane can be a modified polyurethane obtained by varying the structure of the monomers in the pre-polymer; a polyolefin can be a modified polyolefin including copolymers of polyolefins or blends; and a epichlorohydrin can be a modified epichlorohydrin copolymerized with varying amount of ethylene oxide.

In various embodiments, the rubber material can further include a variety of additives, such as, for example, plasticizers, softening agents, dispersant aid, and/or compatibilizer, which can be added to render the rubber materials with desired useful properties known to one of the ordinary skill in the art.

In various embodiments, the disclosed bias-able device can include a conductive substrate, that can be formed in various shapes and using any suitable material for bias charging. For example, the conductive substrate can take the form of a cylindrical tube or a solid cylindrical shaft of, for example, stainless steel, aluminum, copper, or certain plastic materials chosen to maintain rigidity, structural integrity and be capable of readily responding to a biasing potential placed thereon. For example, the conductive substrate can be a solid cylindrical shaft of stainless steel.

Generally, the bias of the bias-able device can be controlled by use of a DC potential. An AC potential can also be used along with the DC controlling potential to aid the charging control. In various embodiments, the bias-able device can be used as BCRs and/or BTRs. The basic construction and operating principal for these two exemplary types of rolls can be similar. For example, in the case of BCRs, an electric field can be created above the air-breakdown limit (i.e., Paschen field limit) in the pre-nip and post-nip regions when the BCRs are loaded against photoreceptor drums. When the field exceeds the Paschen limit, it can break the air down generating a corona current that can charge the photoreceptor. In the case of BTRs, an electric field can be created without breaking down the air. This electric field can then aid the transfer of the toner images from the photoreceptor to the printing substrate.

In various embodiments, the disclosed bias-able device can also include one or more rubber materials disposed upon the conductive substrate and/or other functional layers of the device. In some embodiments, the rubber material can be, for example, coated or cast on the underlying surface, for example, surfaces of the conductive substrate or the other functional layers. In other embodiments, the rubber material can be, for example, extruded or molded to be accommodated with the configurations of the disclosed device.

In various embodiments, the disclosed bias-able device can further include a surface material as an outer layer, for example, a surface protecting and/or resistivity adjusting layer, known to one of ordinary skill in the art. The surface layer (i.e., the outer layer) of the bias-able device can be used to protect the inside layers from abrasion and toner contamination. The surface layer can have a thickness of about 0.01 mm to about 0.1 mm. In various embodiments, the surface layer can be prepared using a variety of polymers or rubbers including, but not limited to, nylons, polyurethanes such as fluorinated polyurethane, fluoropolymers, polyesters, polycarbonates, acrylic acid resins, different kind of celluloses, phenoxy resin, polysulfone, and polyvinylbutyral. In various embodiments, the surface layer can further include conductive fillers, such as, for example, $SnO_2$, $TiO_2$, carbon, and fluorinated carbon. In an exemplary embodiment, polymers with low surface energy, such as polymers containing fluorinated fillers, can be used in the surface material to reduce toner contamination.

Exemplary bias-able devices can have one or more functional layers provided upon a conductive substrate as shown in FIGS. 1A-1B, FIGS. 3A-3B and FIG. 4 in accordance with the present teachings. The rubber material can be used as one of the one or more functional layers to provide uniform mechanical and electrical functions.

Figure 1B:
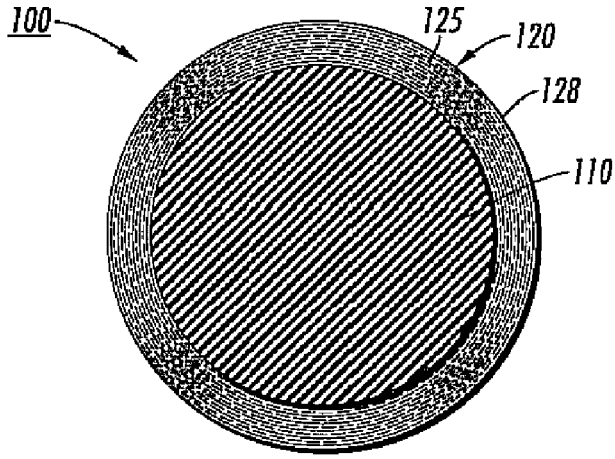

FIGS. 1A-1B depict an exemplary bias-able device 100 including a single-layer structure disposed upon a conductive substrate in accordance with the present teachings. In particular, FIG. 1A is a perspective view of a partial section of the exemplary bias-able device 100, while FIG. 1B is a cross-sectional view of the exemplary bias-able device 100 shown in FIG. 1A. It should be readily apparent to one of ordinary skill in the art that the device depicted in FIGS. 1A-1B represents a generalized schematic illustration and that other layers/materials can be added or existing layers/materials can be removed or modified.

As shown in FIGS. 1A-1B, the exemplary bias-able device 100 can include a conductive substrate 110, and a rubber material 120. The rubber material 120 can be disposed on the conductive substrate 110. The rubber material 120 can include, for example, a plurality of nanotubes 125 distributed throughout a rubber matrix 128.

The conductive substrate 110 can be any conductive substrate as described herein. The size of the conductive substrate 110 can depend on the compliance of the rubber material, and more importantly, the size of the printing machine and the speed of the operation. For example, the conductive substrate 110 can be a solid cylindrical shaft of stainless steel having a diameter of the cylindrical tube of about 1 mm to about 15 mm, and a length of about 10 mm to about 500 mm. In an additional example, the diameter of the conductive substrate 110 can be about 6 mm to about 15 mm and the length can be about 200 mm to about 500 mm. In a further example, the diameter of the conductive substrate 110 can be less than about 6 mm and the length can be less than about 200 mm.

The rubber material 120 can be disposed upon the surface of the conductive substrate 110. The rubber material 120 can be a conductive elastic layer configured to be responsible for the conformability (i.e., compliance) and the resistivity, which can be relative to the process speed and/or the AC frequency in the case of AC/DC condition. That is, the rubber material 120 can provide the nip-forming function and also relax the charge across the layer.

The rubber material 120 can be prepared including one or more rubbers and a plurality of nanotubes as disclosed herein. For example, the rubber material 120 can include a plurality of nanotubes 125 dispersed throughout a rubber matrix 128 as illustrated in FIG. 1A-1B. In this example, the plurality of nanotubes 125 can be oriented in a certain direction throughout the polymer matrix 128 for a desirable function. In various embodiments, a plurality of carbon nanotubes such as SWCNTs can be dispersed physically or chemically throughout various rubber materials such as, for example, epichlorohydrins, urethanes, EPDM (ethylene propylene diene monomers), styrene-butadienes, silicones, chloroprenes, butyl rubbers, isoprenes, polyester thermoplastic rubbers, natural rubbers and the like.

In various embodiments, the rubber material 120, including a plurality of nanotubes within a rubber matrix can be, for example, coated or cast on surface of the conductive substrate 110. In various other embodiments, the rubber material 120 can be, for example, extruded or molded to be accommodated with the configurations of the conductive substrate 110.

In an exemplary embodiment, the rubber material 120 can include rubbers that can be dissolved and cured or polymerized in situ on the surface of the conductive substrate 110 of the bias-able device 100. In another exemplary embodiment, the rubber material 120 can include rubbers having relatively low melting points, which can be blended with biologically active materials and coated on the conductive substrate 110. In an additional embodiment, the rubber material 120 can include biocompatible materials, enzymes and/or their biochemical reactions.

In various embodiments, the rubber material 120 can provide a desired resistivity, for example, ranging from about $10^5$ ohm-cm to $10^{10}$ ohm-cm. This resistivity range can be achieved with a low carbon-nanotube-loading such that the filler effect on compliance and other mechanical properties of the rubber used can be minimal and thus providing a wide material selection latitude. This is also because the electrical percolation of the rubber material 120 can be achieved by a very low carbon-nanotube-loading, for example, about 0.05% by weight. In an exemplary embodiment, the carbon nanotube loading of the rubber material 120 can be about 2% by weight or less.

Figure 2:
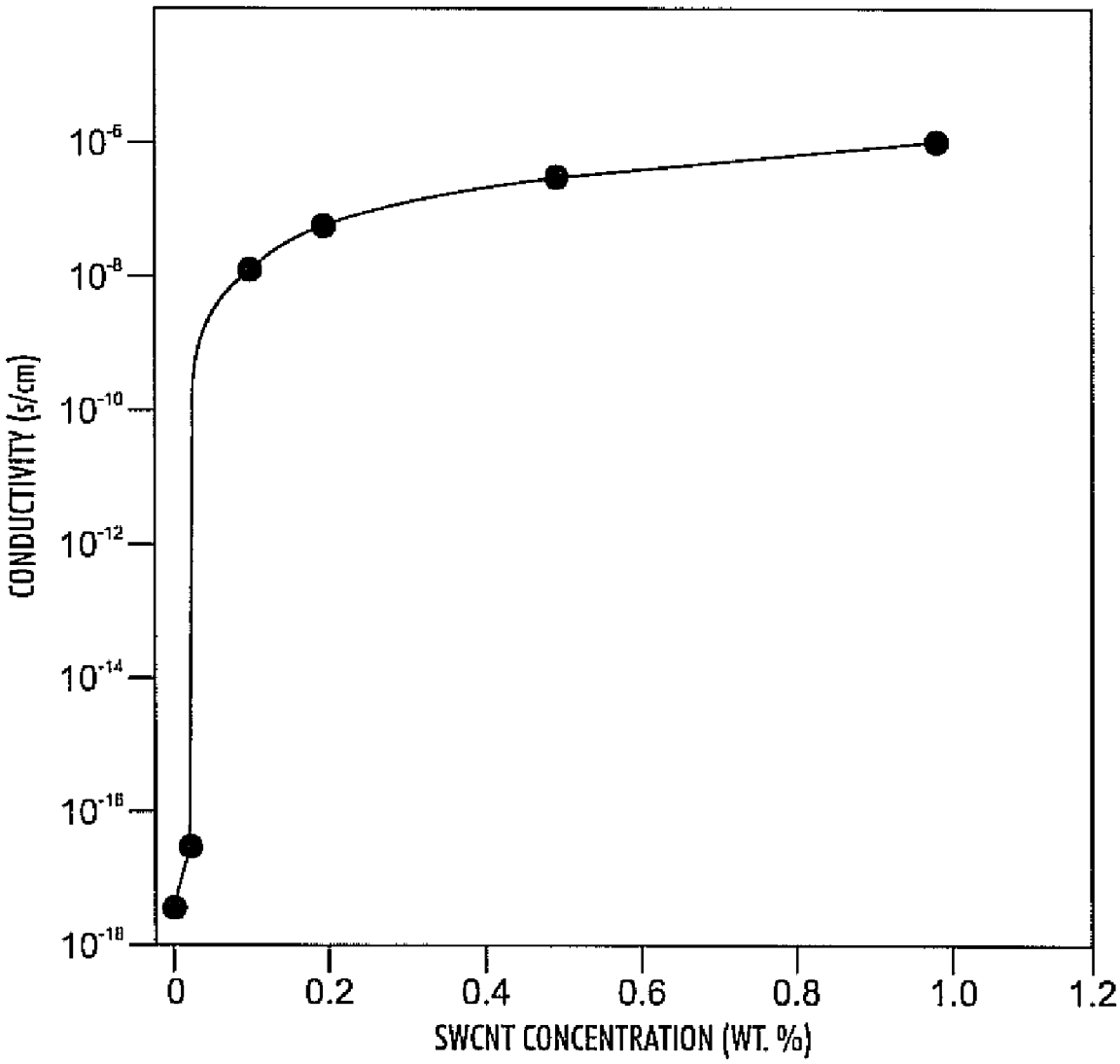
FIG. 2 depicts an exemplary electrical result of a rubber material having a plurality of carbon nanotubes dispersed throughout a rubber matrix in accordance with the present teachings.

FIG. 2 depicts an exemplary electrical result of a rubber material containing SWCNTs in accordance with the present teachings. As shown, when there is no loading of SWCNTs, the conductivity of the exemplary material can be about $10^{-17}$ s/cm ($10^{17}$ ohm-cm). The conductivity of the material can be controlled by adding SWCNTs as conductive fillers to the rubber material. For example, when the loading levels of SWCNTs are in excess of about 0.1 wt. %, the conductivity of the rubber material can be about $10^{-8}$ s/cm ($10^8$ ohm-cm), which can be a desired conductivity/resistivity for the rubber material 120. Various conductivities/resistivities or ranges of conductivity/resistivity can be obtained and determined by the loading levels of the nanotubes (as indicated in FIG. 2) and/or the type of rubbers used.

In various embodiments, other functional layers can be added over the conductive substrate to meet, for example, the abrasion requirement, which can result in dual-, triple-, quad- or multiple-layered bias-able devices. The functional layers including the rubber material can provide desired mechanical, electrical, and surface functions for the bias-able devices in a manner that each of these functions can be separated and/or arbitrary combined in the discrete functional layers. For example, the functional layers can include, but are not limited to, a compliant layer, a conductive elastic layer (e.g., the rubber material), an electroded layer, a resistance adjusting layer, a surface protecting layer, or any other functional layer.

Figure 3A:
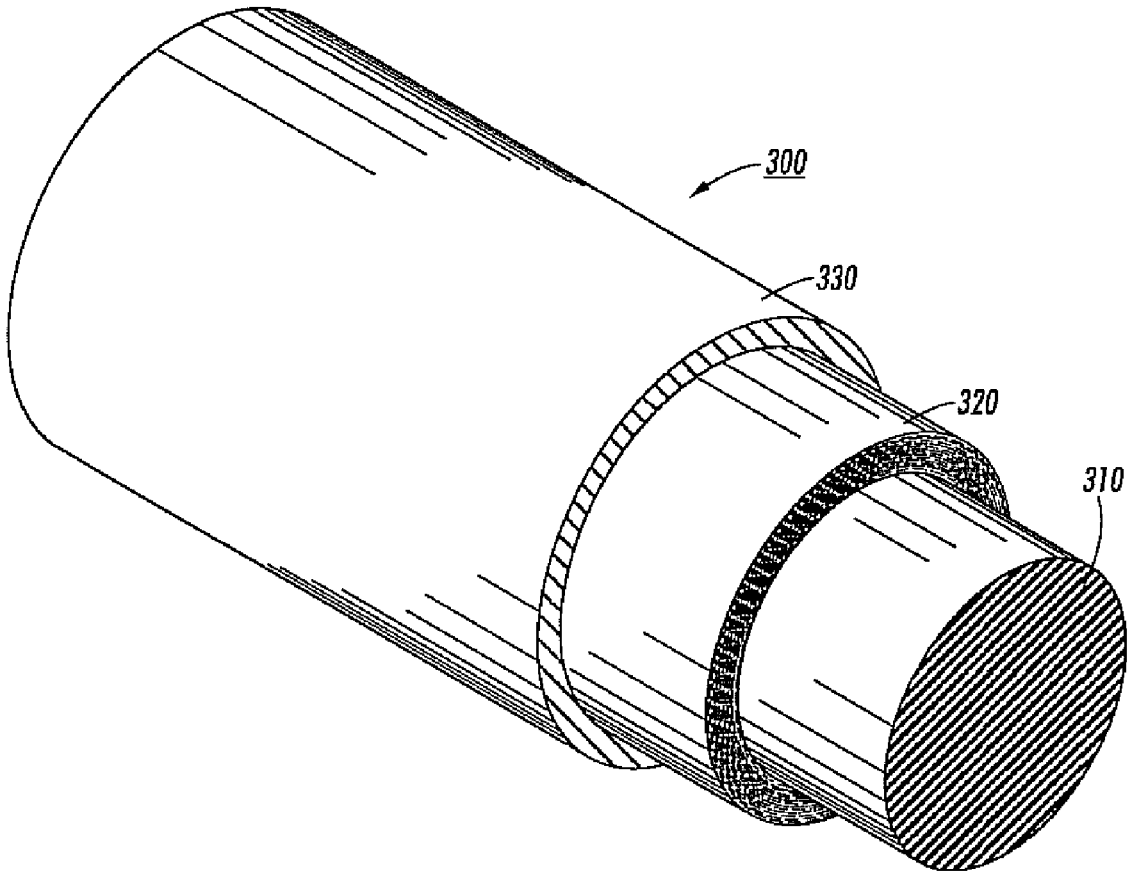
FIGS. 3A-3B depict another exemplary bias-able device including a dual-layer structure in accordance with the present teachings.
Figure 3B:
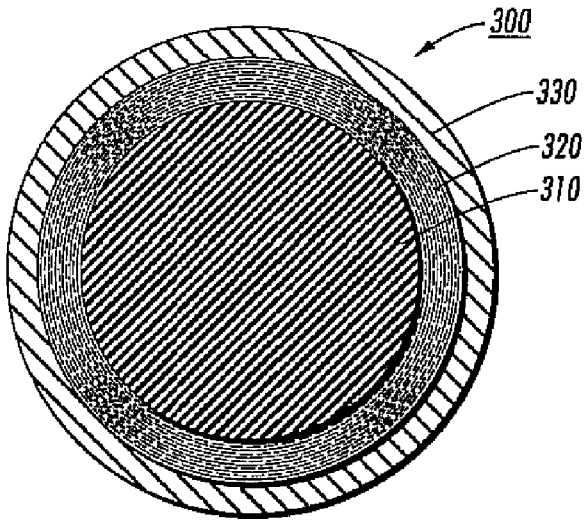

FIGS. 3A-3B depict an exemplary bias-able device 300 having a dual-layer structure coated upon a conductive substrate in accordance with the present teachings. In particular, FIG. 3A is a perspective view in partial section of the exemplary bias-able device 300. FIG. 3B is a cross-sectional view of the exemplary bias-able device 300 shown in FIG. 3A. It should be readily apparent to one of ordinary skill in the art that the devices depicted in FIGS. 3A-3B represent a generalized schematic illustration and that other layers/materials can be added or existing layers/materials can be removed or modified.

As shown in FIGS. 3A-3B, the exemplary bias-able device 300 can include a conductive substrate 310, a rubber material 320, and a surface material 330. The surface material 330 can be a surface resistive/protecting layer disposed on the rubber material 320 forming a dual-layer structure formed on the surface of the conductive substrate 310. In various embodiments, the device 300 can be formed by simply disposing a surface layer on the rubber material 220 of the device 200.

The conductive substrate 310 can use a substrate that is similar to the conductive substrate 110 as described in FIGS. 1A-1B. The rubber material 320 can be any rubber material as disclosed herein disposed upon the surface of the conductive substrate 310 to provide uniform mechanical and electrical properties for the bias-able device 300. The rubber material 320 can be prepared including a plurality of carbon nanotubes distributed within a rubber matrix. In an exemplary embodiment, the rubber materials 320 can include SWCNTs dispersed uniformly throughout rubber matrices including, but not limited to, EPDM (ethylene propylene diene monomers), epichlorohydrins, urethanes, styrene-butadienes, silicones, chloroprenes, butyl rubbers, isoprenes, polyester thermoplastic rubbers, natural rubbers and the like. In various embodiments, the rubber material 320 can include a plurality of SWCNTs with an exemplary weight loading of, for example, about 2.0% or less. In an additional example, the weight loading of SWCNTs can be about 0.1% or less.

The surface material 330 can be disposed on the rubber material 320. The surface material 330 can be any surface material configured as a surface protecting layer and/or a resistivity adjusting layer known to one of ordinary skill in the art. In various embodiments, the resistance of the surface material 330 can dominate the resistance of the bias-able devices 300, for example, a BCR, to reduce the electrical environmental instability of the entire BCR.

In various embodiments, the exemplary dual-layer bias-able device 300 can be used in both BCR and BTR applications. Generally, in a color machine of an electrostato-graphic printing apparatus, there can be a BCR configured to charge the photoreceptor, and there can be at least two BTRs configured in the color machine. For example, there can be two BTRs for the 4-cycle color engine and there can be five BTRs for a 4-color tandem engine. In the 4-cycle color engine, the first BTR can be configured at the nip interface of the photoreceptor and intermediate transfer belt, and the second BTR can be configured at the interface of intermediate transfer belt and, for example, paper. Depending on the application and/or the architecture of the BCRs and BTRs, the electrical requirement of these devices can be different. In addition, the dimensions (e.g., diameter, and/or thickness) of each material of the conductive substrate 310, the rubber material 320 and the surface material 330 can also depend on the machine architecture and the intended operating speed.

According to various embodiments when the bias-able device 300 is used for a BCR application, the rubber material 320 can have a thickness of about 1-3 mm and provide a resistivity ranging from about $10^4$ ohm-cm to about $10^8$ ohm-cm at the operating field. The surface material 330 can have a thickness of about 0.01-0.1 mm and provide a resistivity of about $10^7$ ohm-cm to about $10^{11}$ ohm-cm.

According to various embodiments when the bias-able device 300 is used for an application of the first BTR of the 4-cycle color engine, the rubber material 320 can have a thickness of about 3-5 mm and provide a resistivity ranging from about $10^5$ ohm-cm to about $10^{10}$ ohm-cm at the operating field. The surface material 330 can have a thickness of about 0.01-0.1 mm and provide a resistivity of about $10^8$ to about $10^{12}$ ohm-cm. In this case, the conductive substrate 310 can be, for example, a stainless steel shaft, and can have a diameter of about 8-12 mm.

Figure 4:
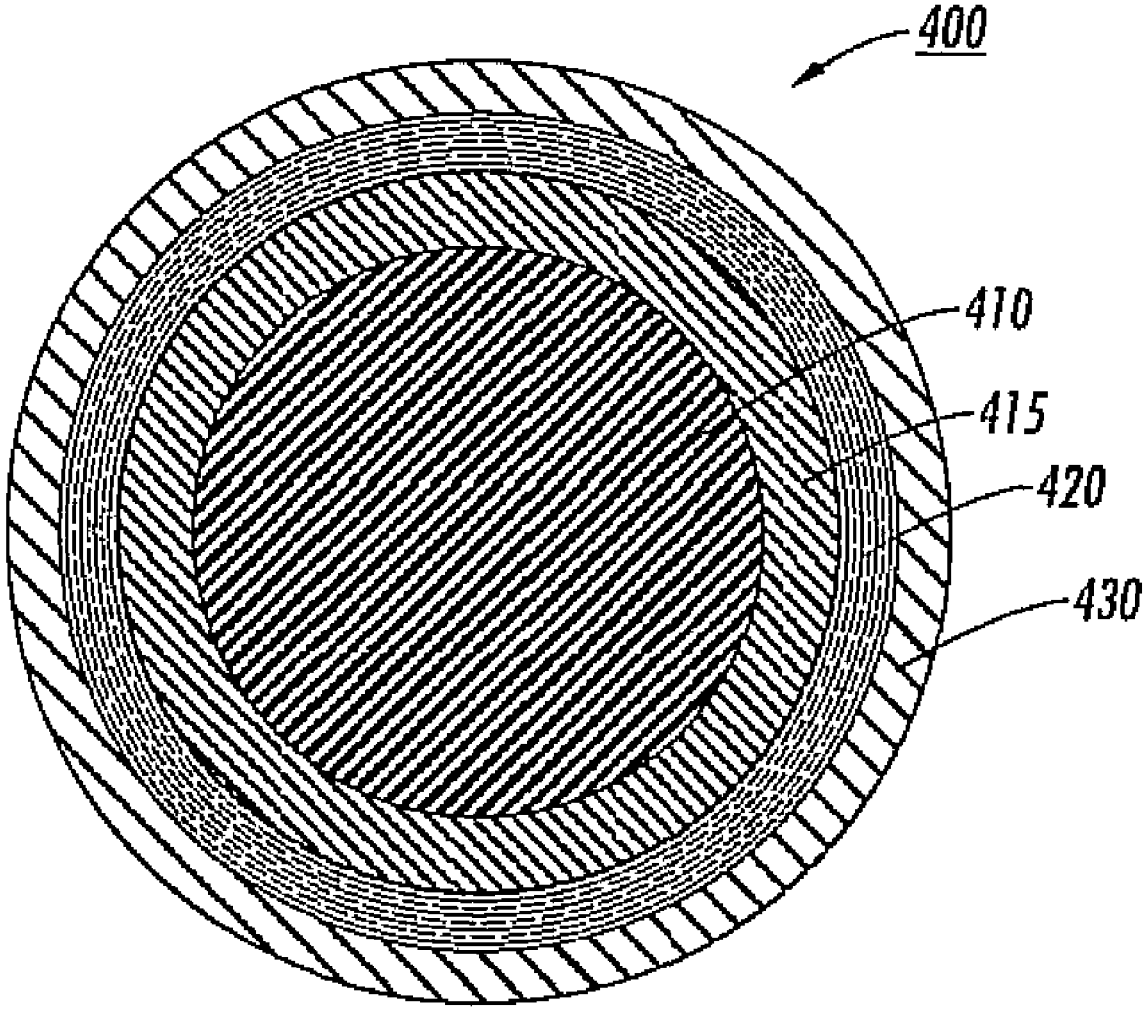
FIG. 4 depicts an additional exemplary bias-able device including a triple-layer structure in accordance with the present teachings.

FIG. 4 depicts an exemplary bias-able device 400 having a triple-layer structure disposed upon a conductive substrate in accordance with the present teachings. In particular, FIG. 4 is a cross-sectional view of the exemplary bias-able device 400. It should be readily apparent to one of ordinary skill in the art that the devices depicted in FIG. 4 represents a generalized schematic illustration and that other layers/materials can be added or existing layers/materials can be removed or modified.

As shown in FIG. 4, the exemplary bias-able device 400 can include a conductive substrate 410, a conductive foam 415, a rubber material 420, and a surface material 430. The surface material 430 can be an outer layer disposed on the rubber material 420 disposed on the conductive foam 415 and form a triple-layer structure disposed on the surface of the conductive substrate 410.

The conductive substrate 410 can be a substrate that is similar to the conductive substrate 110 and/or the conductive substrate 310 as described in FIGS. 1A-1B and/or FIG. 3. In various embodiments, the conductive substrate 410 can be, for example, a stainless steel shaft.

The conductive foam 415 can be, for example, a conductive polyurethane foam to provide additional compliance for the device 400. The conductive foam 415 can be formed by, for example, molding the foam material according to the configuration of the conductive substrate 410.

The rubber material 420 can be any disclosed rubber material disposed upon the surface of the conductive foam 415. The rubber material 420 can be similar to the rubber material 120 and/or 320 as described in FIG. 1 and/or FIG. 3 to provide uniform mechanical and electrical properties for the bias-able device 400.

The surface material 430 can be disposed on the rubber material 420. The surface material 430 can be any surface material configured as a surface protecting and/or resistivity adjusting layer known to one of ordinary skill in the art.

In various embodiments, the device 400 can have a large size for each layer and can be more compliant. For example, the bias-able device 400 can be used for an application of the second BTR for the exemplary 4-cycle color engine. In this example, the conductive substrate 410 can be, for example, a stainless steel shaft, and can have a diameter of about 10 mm to about 15 mm. The conductive foam 415 can have a thickness of, for example, about 3 mm to about 5 mm. The rubber material 420 can have a thickness of about 3 mm to about 5 mm.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A bias-able device consisting essentially of:

a conductive substrate;

a rubber material disposed over the conductive substrate, wherein the rubber material comprises a plurality of nanotubes distributed throughout a rubber matrix to provide the rubber material with a mechanical conformability and an electrical resistivity of about $10^5$ ohm-cm to about $10^{10}$ ohm-cm and wherein the rubber matrix comprises one or more rubbers selected from the group consisting of ethylene-propylene-diene monomers (EPDM), epichiorohydrins, urethanes styrene-butadienes, silicons, nitrile rubbers, butyl rubbers, polyester thermoplastic rubbers, natural rubbers, and one or more biocompatible rubbers selected from the group consisting of polycarboxylic acids, polyvinylpyrrolidone, and cellulosic polymers, and wherein the plurality of nanotubes has a weight loading of about 0.1% or less throughout the rubber matrix;

a surface material disposed over the rubber material; and a conductive foam disposed between the conductive substrate and the rubber material.

2. The device of claim 1, wherein the bias-able device is one of a bias charging roll (BCR) and a bias transfer roll (BTR).

3. The device of claim 1, wherein the conductive substrate has a shape selected from the group consisting of a core, a belt, and a film.

4. The device of claim 1, wherein the conductive substrate comprises a stainless steel shaft having a diameter of about 6 mm to about 15 mm and a length of about 200 mm to about 500 mm.

5. The device of claim 1, wherein each of the plurality of nanotubes comprises a single wall carbon nanotube (SWCNT) or a multi-wall carbon nanotube.

6. The device of claim 1, wherein each of the plurality of nanotubes has a cross sectional shape selected from the group consisting of a polygon, a rectangle, a square, an oval, and a circle.

7. The device of claim 1, wherein distribution of the plurality of nanotubes throughout the rubber matrix is uniform or spatially-controlled.

8. The device of claim 1, further comprising one or more functional layers disposed over the conductive substrate, wherein the one or more functional layers comprise one or more of a compliant layer, an electroded layer, a resistance adjusting layer, or a surface protecting layer.

9. An electrostato-graphic printer comprising the bias-able device of claim 1.

10. A method for forming a bias-able device consisting essentially of:

providing an electrically conductive core;

forming a conductive foam on the electrically conductive core by molding a foam material on the electrically conductive core;

forming a rubber material on the conductive foam by dispersing a plurality of nanotubes within a rubber matrix wherein the rubber matrix comprises one or more rubbers selected from the group consisting of ethylene-propylene-diene monomers (EPDM), epichlorohydrins, urethanes styrene-butadienes, silicons, nitrile rubbers, butyl rubbers, polyester thermoplastic rubbers, natural rubbers, and one or more biocompatible rubbers selected from the group consisting of polycarboxylic acids, polyvinylpyrrolidone, and cellulosic polymers, and wherein the plurality of nanotubes provides the rubber material with an electrical resistivity and a mechanical conformability and wherein the plurality of nanotubes has a weight loading of about 0.1% or less throughout the rubber matrix; and disposing a surface material on the rubber material to provide a protecting surface.

11. The method of claim 10, wherein a step of forming the rubber material comprises one or more processes chosen from the group consisting of coating, casting, extrusion or molding.

12. The method of claim 10, wherein forming the rubber material comprises one of an in-situ polymerization and an in-situ curing of the rubber matrix on the electrically conductive core.

13. The method of claim 10, wherein the plurality of nanotubes is dispersed throughout the rubber matrix by one or more of a physical mixing and a chemical reaction.

14. A bias-able device consisting essentially of:

an electrically conductive core;

a rubber material disposed over and surrounding the electrically conductive core, wherein the rubber material comprises a plurality of nanotubes dispersed throughout a rubber matrix to provide the rubber material with a first electrical resistivity and a mechanical conformability and wherein the rubber matrix comprises one or more rubbers selected from the group consisting of ethylene-propylene-diene monomers (EPDM), epichlorohydrins, urethanes styrene-butadienes, silicons, nitrile rubbers, butyl rubbers, polyester thermoplastic rubbers, natural rubbers, and one or more biocompatible rubbers selected from the group consisting of polycarboxylic acids, polyvinylpyrrolidone, and cellulosic polymers, and wherein the plurality of nanotubes has a weight loading of about 0.1% or less throughout the rubber matrix;

a conductive foam disposed between the electrically conductive core and the rubber material to provide an additional mechanical conformability; and a surface material disposed over and surrounding the rubber material, wherein the surface material comprises a second electrical resistivity and a protecting surface.

15. The device of claim 14, wherein the surface material has a thickness of about 0.01 mm to about 0.1 mm.

16. The device of claim 14, wherein the bias-able device is a bias charging roll (BCR) having the first electrical resistivity of about $10^4$ ohm-cm to about $10^8$ ohm-cm for the nanotube-containing rubber material, the second electrical resistivity of about $10^7$ ohm-cm to about $10^{11}$ ohm-cm for the surface material, and a thickness of about 1 mm to about 3 mm for the nanotube-containing rubber material.

17. The device of claim 14, wherein the bias-able device is a bias transfer roll (BTR) having the first electrical resistivity of about $10^5$ ohm-cm to about $10^{10}$ ohm-cm for the nanotube-containing rubber material, the second electrical resistivity of about $10^8$ ohm-cm to about $10^{12}$ ohm-cm for the surface material, and a thickness of about 3 mm to about 5 mm for the nanotube-containing rubber material.

18. The device of claim 14, wherein the conductive foam comprises a polyurethane.

19. The device of claim 18, wherein the bias-able device is a bias transfer roll (BTR) in a 4-cycle color engine, wherein the electrically conductive core has a diameter of about 10 mm to about 15 mm, the conductive foam has a thickness of about 3 mm to about 5 mm, and the rubber material has a thickness of about 3 mm to about 5 mm.

* * * * *